US006311330B1

(12) United States Patent
Rothman

(10) Patent No.: US 6,311,330 B1
(45) Date of Patent: Nov. 6, 2001

(54) OUTDOOR SPECTATOR COVER

(76) Inventor: Joey Rothman, 6516 26$^{th}$ St., Greeley, CO (US) 80634

( * ) Notice: Subject to any disclaimer, the term of this patent is extended or adjusted under 35 U.S.C. 154(b) by 0 days.

(21) Appl. No.: 09/690,244

(22) Filed: Oct. 17, 2000

Related U.S. Application Data

(60) Provisional application No. 60/209,404, filed on Jun. 1, 2000.

(51) Int. Cl.$^{7}$ ..... A41D 1/00
(52) U.S. Cl. ..... 2/69; 2/69.5
(58) Field of Search ..... 2/69, 69.5, 80, 2/83, 22, 247, 46, 47, 48, 89, DIG. 7, 70, 71, 72; 5/482, 484, 485, 494

(56) References Cited

U.S. PATENT DOCUMENTS

| | | | | |
|---|---|---|---|---|
| 2,716,239 | * | 8/1955 | Barndollar | 2/69 |
| 3,443,066 | * | 5/1969 | Weibel | 2/69 |
| 3,597,764 | * | 8/1971 | Porey | 2/69 |
| 5,283,909 | * | 2/1994 | Hill | 2/69 |

* cited by examiner

*Primary Examiner*—Gloria M. Hale

(74) *Attorney, Agent, or Firm*—David S. Woronoff

(57) ABSTRACT

A novel cover for a spectator having a generally tubular or cylindrical shape open at one end and closed at the other end having an approximate twenty inch diameter and an axial length of about forty-five inches when finished. The lower portion of the cylinder is formed of a multi-layer material with a waterproof base of about twenty inches in diameter and eight inches in axial length when finished. The waterproof base has an inner insulated layer. The upper portion of the bag is formed of a wind and water resistant material such as a dense or tightly woven nylon material. The upper portion of the bag is kept open along the major part of its axial length. Along the axial portion of the bag on either side of the opening are mating hook and loop fastening material. At the other end of the bag, away from the base, is formed a runway through which runs a cord formed of polyester or nylon. The cord exits the runway either at the end thereof or through eyelits. The cord has a termination to prevent the cord from sliding into the stitched runway. Pockets are attached to the bag. One pocket is inside the bag at the upper or waist level and the other on the outside of the bag at a level between one-third to one-quarter the distance from the base of the bag. The pockets may be closed by any suitable closing structure. The entire bag can be fitted in a carry bag, cylindrical in shape, with a rimmed top for a shoulder strap which acts as a closure for the carry bag. A clasp is attached to the carry bag to enable its attachment to the bag while the bag is itself in use.

5 Claims, 3 Drawing Sheets

OUTDOOR SPECTATOR COVER

The present application claims priority based upon provisional patent application No. 60/209,404, D filed Jun. 1, 2000 by the same inventor as this application.

BACKGROUND OF THE INVENTION

The present invention relates to the invention of a novel cover which encloses the lower portion of the body of a person who is exposed to the cold and sometimes wet conditions obtaining at sporting events such as football or soccer games or any other outdoor activity.

1. Field of the Invention

The present invention relates to the field of protective devices or garments primarily intended for use by spectators at sporting events. Many of such sporting events are presented in large stadiums designed to hold tens of thousands of people on floor and seats of concrete, metal, wood, or other hard heat conducting surfaces. In many such outdoor stadiums, the stadium receives heavy snow or rain or both and the depth of moisture in the stadium is often more than six inches. For this reason, waterproofing to at least that depth is exceedingly important for a spectator cover.

2. Description of the Prior Art

The closest prior art known to the applicant is shown in U.S. Pat. Nos. 5,283,909 and 3,597,764 and 2,242,130. None of these patents shows either the physical structure or the function taught by the present invention. In particular no known structure for such a personal cover shows the combination of flexibility, warmth, and waterproof qualities necessary for the active spectator. The bottom of the cover on which the feet of the spectator rest must be flexible for the spectator to remain properly balanced while moving, stomping and cheering yet dry and warm. The present invention meets all of these objectives. The present invention permits the spectator who is wearing the cover to retain a tactile sense of the surface on which he or she is standing through the very thin bottom surface of the cover which is highly flexible yet waterproof.

SUMMARY OF THE INVENTION

The present invention teaches, in two embodiments, novel spectator covers, generally made of a soft flexible, insulated, waterproof or water resistant material. The present inventive cover must retain sufficient flexibility to enable the user to retain his or her balance in an environment where the spectator is physically active in cheering and mobile enough to permit other spectators to pass by him or her in moving across the row of seats commonly found in a modern sports arena.

DESCRIPTION OF THE PREFERRED EMBODIMENT

Figure 1:
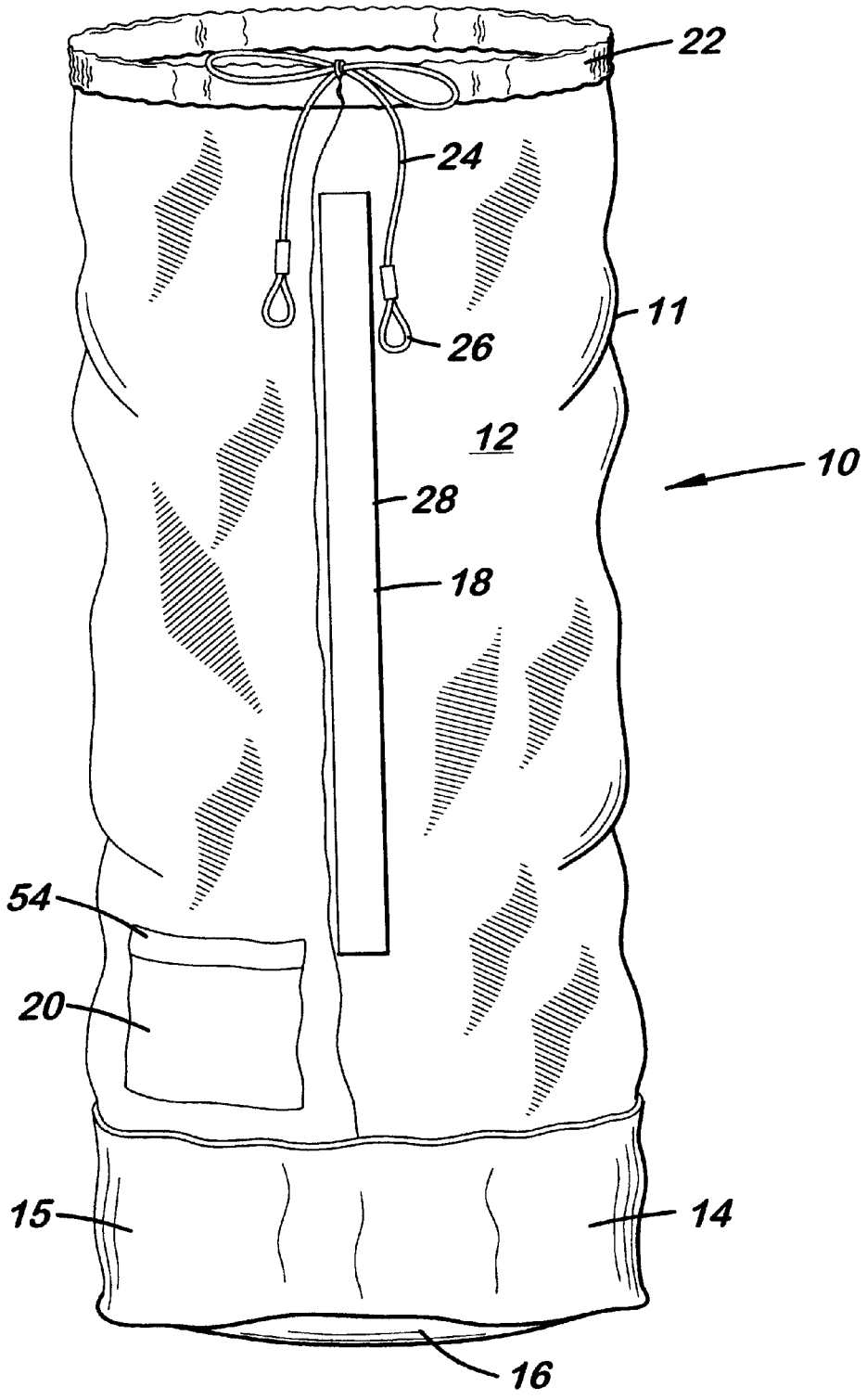
FIGS. 1 shows a front perspective view of one embodiment of the present invention.
Figure 4:
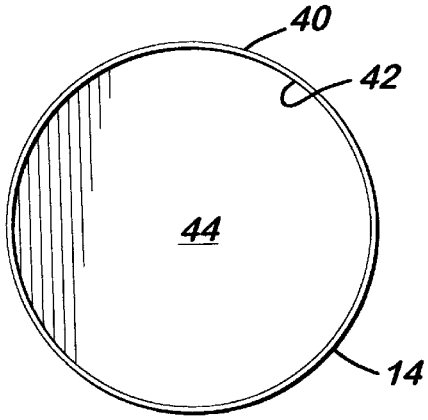
FIG. 4 is a sectional view of the lower portion of the present invention taken along the lines 4—4 shown in FIG. 3.

FIG. 1 is a perspective view of a first embodiment of the present invention in which a novel cover 10 for a spectator at a sporting or other outdoor event is shown. The cover has a generally tubular or cylindrical shape open at one end and closed at the other end and having about a twenty inch diameter and an axial length of about forty-five inches. The lower portion of the cylinder 15 is formed of a two-part multi-layer material with a waterproof base of about twenty inches in diameter and eight inches in axial length when finished. The waterproof base has an inner insulated layer 44 as shown in FIG. 4. The outer layer 40 may be a vinyl or plastic and the inner layer may be wool, cotton, or any other insulating material. The lower portion of the base is formed from an essentially flat circular member 16. The upper portion of the base 14 is formed from a similar material as the lower portion but shaped in a rectangular form that when attached to the base it forms a cylinder about eight inches in axial length and about twenty inches in diameter closed at one end.

The upper portion of the bag 11 is formed of a wind and water resistant material such as dense or tightly woven nylon material for an outer layer 12. Upper portion 11 also has an inner layer 13 of double sided fleece material of wool, cotton, or other suitable fabric which is both soft and flexible.

Figure 2:
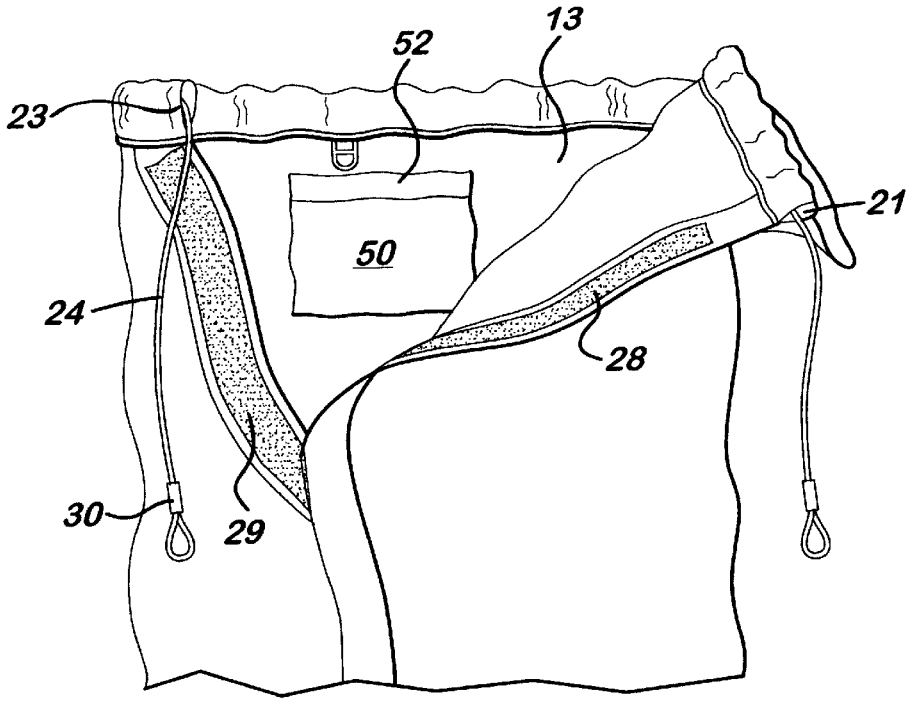
FIGS. 2 and 3 are front perspective views of the embodiment shown in FIGS. 1 showing the upper and lower portions of the present invention.
Figure 3:
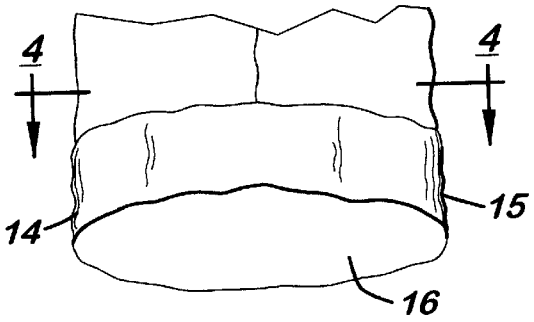

The upper portion 11 of the bag is able to be opened along the major part of its axial length to permit the user easy entry to the bag as shown in FIG. 2 and attached Appendix A which is hereby incorporated by reference into this application. Along the axial portion of the bag on either side of the opening are mating hook and loop fastening material 28 and 29 (although a zipper or other fastener could be substituted for the hook and loop closure).

Figure 5:
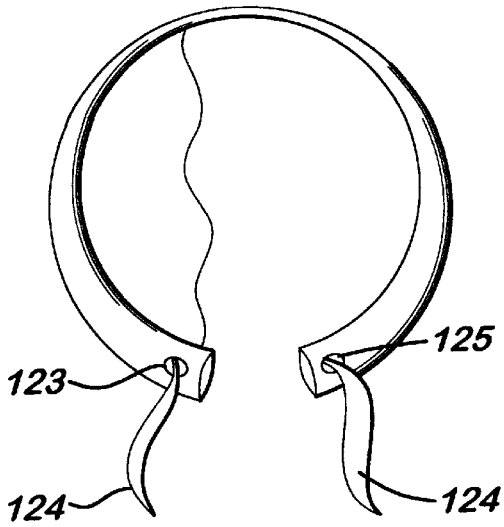
FIG. 5 is a partial perspective view of the upper portion of the present invention showing a second embodiment of the upper portion of the invention.

At the other end of the bag, away from the base 15 is formed, usually by sewing, a runway 22 through which runs a cord 24 formed of polyester or nylon. The cord exits the runway either at the ends thereof 21, 23 or through eyelits 123, 125 shown in FIG. 5 formed in the runway at both ends. If the eyelits 21, 23 are employed, the ends of the runway 22 are closed as shown in FIG. 5. The cord has a "barrel stop" 30 or similar termination to prevent the cord from sliding into the stitched runway.

A plurality of pockets 20 and 50 are attached to the bag. One pocket 50 is inside the bag at the upper or waist level and the other 20 on the outside of the bag at a level between one-third to one-quarter the distance from the base of the bag. Either or both pockets 20, 50 may be closed by either a mating hook and loop closure 54, 52 or any other suitable closing structure.

Figure 6:
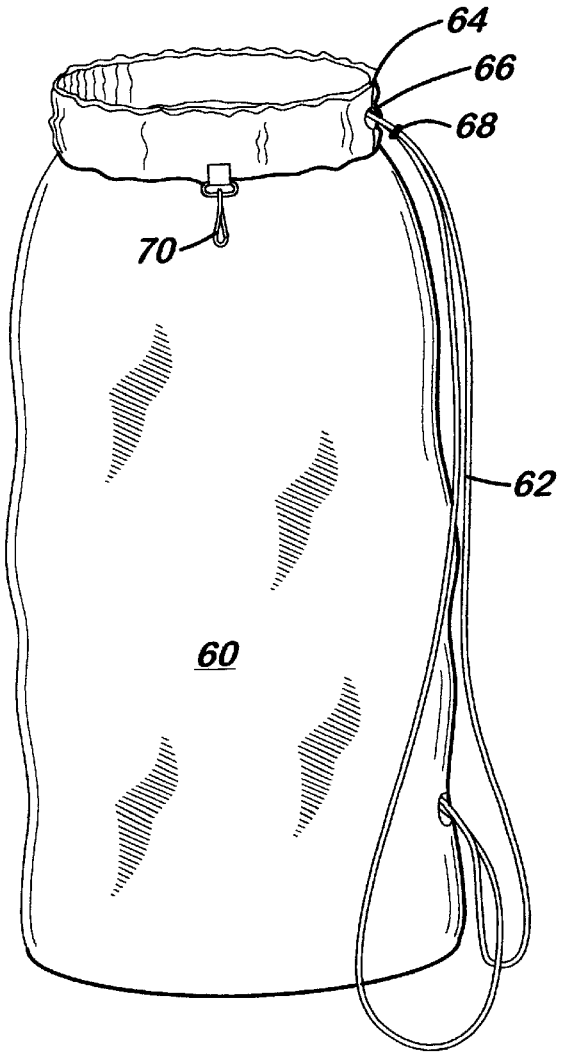
FIG. 6 is a front perspective view of the present invention in its carrying cover forming part of the present invention.

The entire bag is able to be fitted in a carry bag 60, shown in FIG. 6, cylindrical in shape, with a rimmed top 64 with a runway 66 which has an opening 68 for a two cord shoulder strap 62 which acts as a closure for the carry bag. A clasp 70 is attached to the carry bag to enable its attachment to the bag while the spectator cover bag is itself in use.

The embodiments of the present invention which have been shown and described are illustrative of the main principles of the invention but the following claims shall not be limited to the embodiments shown. The claims are intended to cover and do cover those variations of the invention which are apparent to those skilled in the art.

I claim:

1. A cover for a spectator at sporting events comprising:

a first soft, flexible cylindrical upper member has an upper and lower end inside and outside member in which the upper member is able to be opened and closed to permit the insertion of the lower portion of the body of the spectator;

the upper member outside member is formed of a wind and water resistant material and the inside member formed of a heat insulating material;

the upper member has near its upper end a runway member to receive a closure member for closing the upper member tightly about the body of the spectator;

a waterproof base member is attached to the first upper member and is formed of a first circular portion and and a first rectangular portion which are fixed together to form a very thin bottom for the spectator cover;

the base portions are both formed in two layers, a first waterproof layer and a second insulating layer, such that the base member is sufficiently flexible and thin so that the spectator can walk while wearing the cover without losing his or her balance because the spectator does not lose the sense of touch of the surface on which he or she is walking.

2. The spectator cover claimed in claim 1 wherein:

The upper member is open at the upper end wherein the opening is closable by hook and loop fastener members fixed on each side of the opening.

3. The spectator cover claimed in claim 1 wherein the base member extends upwardly toward the open end of the cover about one-fifth of the total length of the cover to provide a waterproof cover of sufficient depth.

4. The spectator cover claimed in claim 1 including further a carry bag member adapted to contain the spectator cover having a closure means at the upper end of the carry bag and a hook for attaching the carry bag to the spectator cover.

5. The spectator cover claimed in claim 1 wherein the base member is waterproof to at least an eight inch length extending upwardly toward the open end.

* * * * *